US005700003A

United States Patent [19]

Sung

[11] Patent Number: 5,700,003

[45] Date of Patent: Dec. 23, 1997

[54] DEVICE FOR SENSING THE REMAINING AMOUNT OF COPY PAPER

[75] Inventor: Moo-Kyung Sung, Suwon, Rep. of Korea

[73] Assignee: SamSung Electronics Co., Ltd., Kyungki-do, Rep. of Korea

[21] Appl. No.: 534,785

[22] Filed: Sep. 27, 1995

[30] Foreign Application Priority Data

Sep. 27, 1994 [KR] Rep. of Korea ..... 24341/1994

[51] Int. Cl.[6] ..... B65H 7/08

[52] U.S. Cl. ..... 271/110; 271/145; 271/162

[58] Field of Search ..... 271/145, 162, 271/110, 38

[56] References Cited

U.S. PATENT DOCUMENTS 4,566,547 1/1986 Furukawa .

5,177,544 1/1993 Kimura et al. .

5,347,350 9/1994 Nakahata et al. .

FOREIGN PATENT DOCUMENTS 58-119530 7/1983 Japan ..... 271/145

5116802 5/1993 Japan ..... 271/145

5186093 7/1993 Japan ..... 271/145

*Primary Examiner*—David H. Bollinger

*Attorney, Agent, or Firm*—Robert E. Bushnell, Esq.

[57] ABSTRACT

A sensing device for sensing a stored amount of paper sheets and displaying the sensed amount of paper sheets. The sensing device comprises: a variable resistor including a rotating unit and a first assembly unit for assembling an actuator in the rotating unit; the actuator including a second assembly unit assembled to the first assembly unit and a paper contacting unit contacted with the paper; and an elastic unit supplying an elastic force to the actuator so as to contact the paper contacting unit with the paper.

11 Claims, 2 Drawing Sheets

DEVICE FOR SENSING THE REMAINING AMOUNT OF COPY PAPER

CROSS REFERENCE TO RELATED APPLICATIONS

This application makes reference to, incorporates the same herein, and claims all benefits accruing under 35 U.S.C §119 from an application entitled *Device for Sensing the Remaining Amount of Copy Paper* earlier filed in the Korean Industrial Property Office on 27 Sep. 1994, which was duly assigned Ser. No. 24341/1994 by that Office.

BACKGROUND OF THE INVENTION

The present invention relates to an image forming apparatus for outputting an image on a paper, and more particularly, to a sensing device for sensing an amount of unused paper sheets stored in the image forming apparatus.

An image forming apparatus such as a page printer of a laser printer, light emitting diode (LED) printer and a terminal printer, etc., is constructed of a paper storing cassette, a paper feeding unit, a printing unit, a discharging unit, an engine controlling unit, a video controlling unit and a displaying unit. Paper sheets necessary for printing are previously stored in the paper storing cassette, and the paper feeding unit feeds the paper stored in the paper storing cassette for printing. The printing unit prints image information such as a previously prepared letter or a picture, etc., on the fed paper by using an electrophotography developing method, a terminal method or an ink scattering method, and so on. The discharging unit discharges the printed paper. The engine controlling unit controls general operations required for the printing process. The video controlling unit is connected to a host such as a personal computer (PC) and receives data necessary of printing in a form of a command or an image to thereby convert the received data into image information, thus transmitting image information to the printing unit. The displaying unit informs a user of a current status of the image forming apparatus.

A connection of the host, transmitting commands for printing to the video controlling unit with the components in the image forming apparatus, is generally made by a serial method such as a centronics, a network or RS-232C422, and the host transmits the command for printing the desired image, a form of the image or a mixture of their data.

In the image forming apparatus constructed as described above, the paper storing cassette a includes paper sensing unit for detecting whether paper is present or absent. The paper presence/absence detection sensor senses the presence and/or absence of the paper necessary for printing before the printing operation is performed, and accordingly if there is no paper available to be printed on, informs the user that the paper necessary for printing is not prepared, through the displaying unit of the image forming apparatus. Due to the above operations of the image forming apparatus. The user can perform a printing operation after supplying paper to the image forming apparatus. As a result, the image forming apparatus provides to the user a greater ease in executing the printing operation, as compared with a case of executing a printing operation without recognizing the fact that there are no paper sheets stored in the paper storing cassette. However, there is problem, usually occurring during the output operation, in that such a sensing operation is not performed until all the paper sheets are used up. Accordingly, the amount of sheets remaining in the paper cassette, before detection that all the sheets have been used, cannot be sensed. This problem may worsen when the user is not in close vicinity of the image forming apparatus, which has to be considered in the following aspect.

When there in only one paper sheet remaining in the paper storing cassette, then the indication "paper absence" is not displayed on the displaying unit. Accordingly, there is a disadvantage in that the user is not warned that the paper supply is almost empty in order to allow the user to resupply the paper storing cassette with more paper sheets.

Furthermore, when amount of data to be printed, e.g., the number of pages to be printed, is more than the number of paper sheets stored in the paper storing cassette and the user does not previously check the amount of paper sheets remaining, the paper sheets are of course all used up during the printing operation, thus causing the printing operation to be inconveniently stopped before finishing the printing of all the data. In this case, the user has to wait in the vicinity of the image forming apparatus until data to be printed is completely printed, and then if all the paper sheets have ben used, the user has to resupply the paper storing cassette with more paper sheets. I have observed that when the user leaves the vicinity of the image forming apparatus for a moment before all of data to be printed is completely printed, and then goes back to the image forming apparatus, the user recognizes that the printing operation has unexpectedly stopped due to the lack of a sufficient amount of paper sheets. Thus, the user inconveniently has to resupply the paper storing cassette with more paper sheets and then wait until the data remaining to be printed has been completely printed.

FIG. 1 is a schematic diagram illustrating an example of structure of an a typical paper sensing device having such problems as mentioned above. In a case where only a single paper sheet remains in a paper storing cassette (not shown), the paper sensing unit 1 of FIG. 1 determines that there is paper remaining in the paper storing cassette capable of data printed thereon, and accordingly transmits a status message via a status transmitting unit 3 for display on displaying unit 2 of the image forming device. The status message in this case provides an indication that the image forming device is ready to perform a priming operation. Displaying unit 2 will only display a message indicating that the paper storing cassette is empty when paper sensing unit 1 fails to detect a paper sheet in the paper storing cassette. Moreover, as in the case where a host, e.g., personal computer, 4 transmits a print command to the image forming device when the image forming device is in the state that the paper storing cassette is empty of any paper sheets, a status message indicating that the image forming device may be out of paper is displayed on a display of host 4. A signal indicative of the existence or nonexistence state of paper sheets is generally transmitted from the image forming device to the host 4 through a cable acting as a signal line through a centronics interface called a print port. The conventional centronics interface generally referred to as the print port can transmit data in only one direction from the host 4 to peripheral devices. However, nowadays it is preferred to use a method of transmitting data from the peripheral devices to the host 4 under the standards of the IEEE P 1284 or to use a method of modifying some parts of the conventional signal processing operation.

Consequently, the image forming device as described above does not inform the user, through the host 4, whether or not there is a sufficient amount of paper sheets stored in paper storing cassette to allow all the data to be printed without interruption at the moment that the printing operation is started. As a result, the user has to be in close vicinity to the host or the image forming apparatus until the printing operation for the desired data is completed. Moreover, when the paper storing cassette becomes empty during the printing operation the printing operation ceases and a message is provided to displaying unit 2 and/or host 4 indicating that the printing operation has stopped because of a lack of paper. Accordingly, the user must then perform the paper resupplying operation as mentioned above thus causing the total time required for completing the printing operation to be increased.

In order to overcome the problems mentioned above devices for displaying indications regarding the amount of print paper sheets remaining to be printed on are known. These displaying device sense, for example, the position of a loading member where papers are loaded and whenever the remaining amount of paper sheets reaches a predetermined level, displays the sensed state.

One remaining amount indicator for indicating the remaining amount of paper in a copying machine is discussed in U.S. Pat. No. 4,566,547 by Hideaki Furukawa and entitled *Remaining Amount Indicator*. This remaining amount indicator uses a plurality of photo-transistors arranged at one end of a paper cassette for detecting light transmitted through a side wall of the paper cassette and depending on the amount of paper remaining in the paper cassette, a green diode array is illuminated. As the paper is removed, during copying operations, from the paper cassette certain ones of the diode array will sequentially turn off When the paper remaining in the paper cassette reaches a predetermined amount two of the green diodes will begin to flash on and off to indicate the amount of paper is low. When all the paper is removed from the paper cassette the all the green diodes are turned off and a red diode array is then illuminated. There still exists a problem wherein the number of pages to be copied may be greater than the number of paper sheets remaining in the paper cassette when the green diodes are no flashing and the red diodes are not illuminated.

U.S. Pat. No. 4,734,747 to Masakiyo Okuda et al. and entitled *Copying Machine With A Copy Paper Detection Device* discusses a device for detecting the amount of paper remaining in a paper cassette. In this copying machine, before a reservation printing is performed, the user is informed of the remaining amount of paper sheets by a numerical display device, by which the user can beforehand recognize whether or not the amount of paper sheets for printing is enough. Additionally, the user is required to input a number depicting how many pages there are to be copied and the number of pages to be copied is compared with the number, stored in memory, of pages that are supposed to be in the paper cassette. When the number input by the operator exceeds the number stored in memory then the user is warned by a visual display or an alarm. When the number of pages to be copied is large this places a burden on the user to determine how many pages there are to be copied. Further, there is a problem in that the number stored in memory may not accurately depict how many paper sheets there are in the paper cassette. Herein, a light emitting element is provided on one side of the paper cassette, and a vertical array of a plurality of light detecting elements is provided at predetermined intervals along one wall of the paper cassette. As paper is removed from the paper cassette the number of light detecting elements capable of detecting light emitted from the light emitting element increases thereby providing an indication of the amount of paper remaining in the paper cassette. However, since the light detectors are larger than the thickness of the a sheet of paper then the indication of how much paper remains in the paper cassette is only an approximation not an actual amount indication.

The use of a plurality of light detectors as discussed with regard to the aforementioned patents provides for a complicated structure of the image forming apparatus can not provide a reasonably close approximation of how much paper remains in the paper cassette.

U.S. Pat. No. 5,177,544, to Shigeki Kimura et al. and entitled *Image Forming Apparatus Capable Of Detecting A Residual Amount Of Cut Paper* discusses an image forming apparatus such as a facsimile machine wherein a paper cassette is provided to hold the paper stack ready to be printed on. There is a ink roller provided which coats a portion of a plurality of sheets on the bottom of the stack with an ink, which disappears after a period of time, so that when these sheets are discharged after printing thereon, the user notices the ink which informs the user that the supply of paper in the paper cassette is getting low. There is a problem when the facsimile machine remains on to receive transmitted data when no-one is around to monitor the paper being discharged. In such a case the ink disappears after the above mentioned period of time and when the user returns to the machine he is unaware that the paper supply in the paper cassette is low.

U.S. Pat. No. 5,347,350 to Akinobu Nakahata et al. and entitled *Sheet Feeder* discusses a paper absence detector having paper sheet sensors comprised of photointerrupters and levers wherein the levers rest on a stack of paper sheets within a paper cassette and as long as there is sufficient paper stacked in the paper cassette the levers lie in the path between the photoemitter and photodetector of the photointerrupter, so that the photointerrupters are in the on state. When the height of the stack of paper in the paper cassette is less than a predetermined height the levers rotate downward causing the photodetector to detect light from the photoemitter thus placing the photointerrupter in the off state. When the photointerrupters are in the off state a paper feeding operation is stopped.

SUMMARY OF THE INVENTION

It is therefore an object of the present invention to provide a sensing device capable of sensing an amount of copy paper to overcome the problems mentioned above.

It is another object of the present invention to provide a sensing device capable of sensing the remaining amount of copy paper and thus starting a printing operation after previously storing the amount of paper enough to print data, thus reducing loss of time and a user's inconvenience caused due to repetition of operations such as a re-supply of paper and re-command for the printing.

It is still another object of the present invention to provide a sensing device being constructed with a simple structure and capable of sensing the remaining amount of copy paper.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

In the following detailed description, many specific details are set forth to provide a more thorough understanding of the present invention. It will be apparent, however, to those skilled in the art, that the present invention may be practiced without these specific details. In other instances, well known circuits have not been described so as not to obscure the present invention.

DETAILED DESCRIPTION OF THE PREFERRED EMBODIMENT

Figure 1:
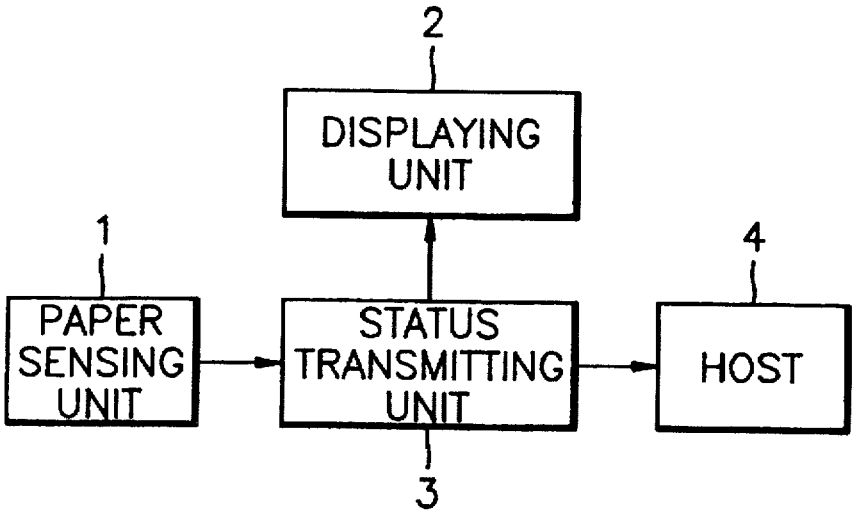
FIG. 1 is a schematic block diagram illustrating an example of structure of a typical sensing device for sensing presence and/or absence of copy paper.
Figure 2:
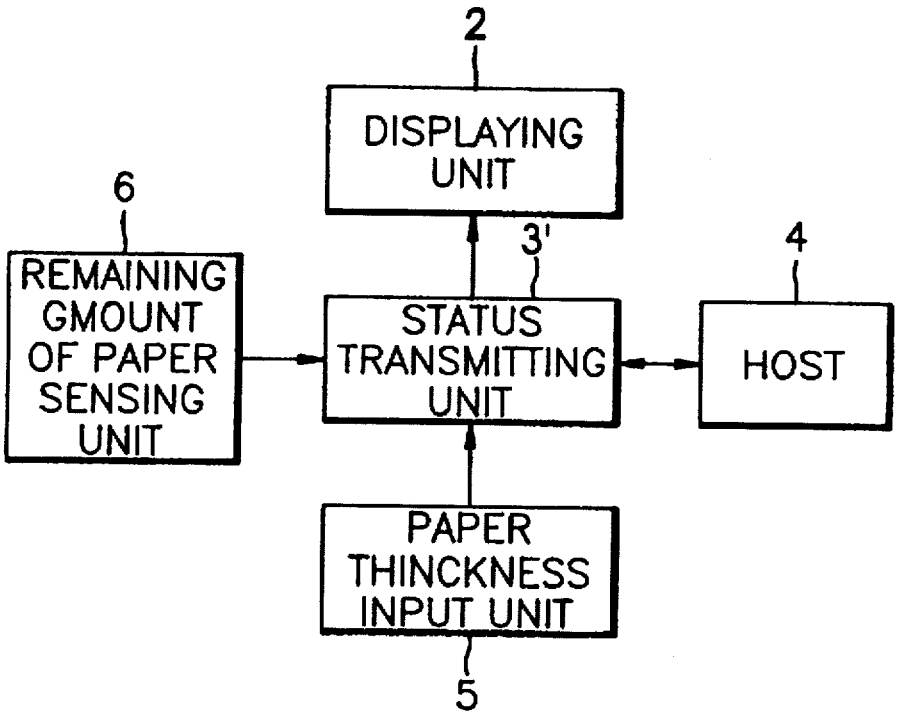
FIG. 2 is a schematic block diagram illustrating the structure of a sensing device for sensing a stored amount of paper sheets constructed according to the principles of the present invention.

FIG. 2 is a schematic block diagram illustrating the structure of a sensing device for sensing the remaining amount of paper sheets stored in an image forming apparatus constructed according to the principles of the present invention. The sensing device for the image forming apparatus, as shown in FIG. 2, has a remaining amount of paper sensing unit 6 capable of sensing the remaining amount of paper sheets, a paper thickness input unit 5, a status transmitting unit 3', a displaying unit 2 and a host 4 such as a personal computer. The displaying unit 2 and the host 4 operate as discussed above with regard to FIG. 1. Status transmitting unit 3' operates in a manner similar to that of status transmitting unit 3 discussed above with respect to FIG. 1 except that the status transmitting unit 3' is capable of transmitting data provided by paper thickness input unit 5 to host 4.

The remaining amount of paper sensing unit 6 generates a signal indicative of the remaining amount of paper sheets stored in, for example, a paper cassette of an image forming apparatus. When information regarding the remaining amount of paper sheets is required in the host 4 or in the image forming apparatus, the status transmitting unit 3' transmits the information regarding the remaining amount of paper sheets to the host 4 and/or displaying unit 2. When the remaining amount of paper sheets is less than that required to complete a copying or printing operation, e.g., the number of pages to be printed is greater than the remaining amount of paper sheets, the host 4 informs the user of this state by displaying a message indicative of this state. When the user desires to obtain information regarding the remaining amount of paper sheets stored in the image forming apparatus, the image forming apparatus transmits information regarding the stored amount of paper sheets to the host 4, and the host 4 displays the transmitted information on a display screen thereby providing the user with the requested information regarding the remaining amount of stored paper sheets.

In the preferred embodiment according to the principles of the present invention, since information regarding the remaining amount of stored paper sheets can be transmitted, in response to the signal output by the remaining amount of paper sensing unit, to the host 4 for display, the user can easily determine whether the remaining amount of stored paper sheets is sufficient for the printing operation which is to be performed.

Further, in accordance with a preferred embodiment of the present invention, the remaining amount of paper sheets are stored in a stack and are sensed by the height of the stacked paper sheets. Since the height of the stacked paper sheets can be changed by the number of paper sheets as well as by the thickness of the paper, information regarding the thickness of paper can be input via paper thickness input unit 5 in order to more accurately calculate the remaining amount of stored paper sheets. On the other hand, information regarding the thickness of the paper can be input by a keyboard at host 4 or a program in host 4.

Figure 3:
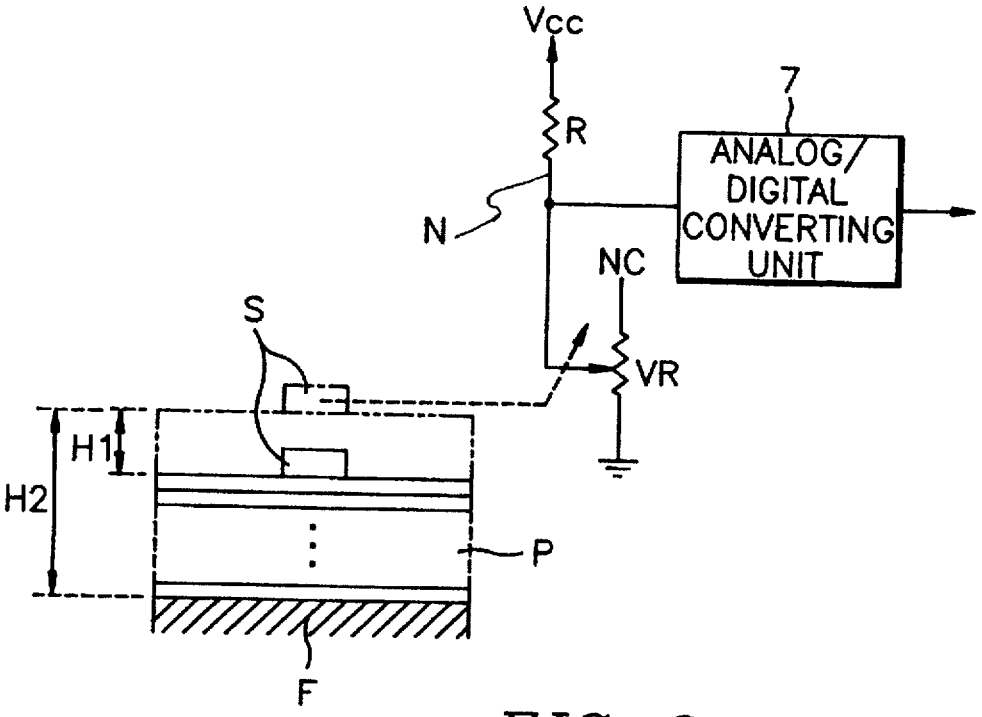
FIG. 3 is a view illustrating the concrete structure of a sensing unit for sensing a stored amount of paper sheets of FIG. 2.

FIG. 3 is a view illustrating the structure of the remaining amount of paper sensing unit 6 of FIG. 2 and will be described in detail as follows. The height H of the stack of remaining paper sheets changes according to the number of paper sheets used during a printing operation stored amount of paper sheets. A reference point F for detecting the height H of the stack is fixed to the bottom of the paper storing unit, i.e., paper cassette. That is, when paper is added to the stack of paper sheets P the height H rises, and when paper is removed from the stack of paper sheets P the height H is lowered. In order to sense the change in the height of the stack of paper sheets, a sensor S of the remaining amount of paper sensing unit 6 is disposed to be in contact with the top most sheet of the stack of stored paper sheets, so that the sensor is mechanically moved according to the direction of change in height, i.e., increase or decrease, of stack of stored paper sheets. As a result, when paper is added to the stack to increase its height sensor S rises and paper is removed from the stack the sensor S is lowered.

When a change of the height H in accordance with a change in the amount of stored paper sheets is increased or decreased by H1, the sensing unit 6 which is in contact with the upper side of the top most sheet of stored paper sheets is also mechanically risen or lowered by H1. In order to determine the value of this change in paper height the sensor S of the sensing unit 6 is directly connected to a variable resistor VR or connected thereto by a mechanical linker. Variable resistor VR is connected between ground and another resistor R which is connected to a reference voltage VCC. The connecting node N between resistor R and variable resistor VR is provides a divided voltage value to an analog-to-digital converting unit 7. A change in the position of sensor S of the sensing unit 6 according to the change H1 in the remaining amount of stored paper sheets changes the resistance value of the variable resistor VR mechanically connected thereto, and then a value of the voltage a N is provided to analog-to-digital converter 7 and converted into a digital value. As a result, a digital value is provided to host 4 via status transmitting unit 3' in order to determine the amount of paper sheets remaining in the paper cassette. Accordingly, as the amount of paper remaining in the stack decreases the resistance value of the variable resistor will, for example, decrease, and as the amount of paper in the stack is increased the resistance value of the variable resistor will increase.

It should be apparent that the status transmitting unit 3 can be constructed to provide data from the remaining amount of paper sensing unit 6 and data from the paper thickness input unit 5 to host 4 in order to compute the number of sheets remaining in the paper cassette, or it can be constructed to compute the number of sheets remaining in the paper cassette in response to the data from the remaining amount of paper sensing unit 6 and data from the paper thickness input unit 5. Further, if the information regarding the paper thickness is not input by the user, then information of the thickness of the paper usually used, or previously input, and stored therein is used in the computation.

Figure 4:
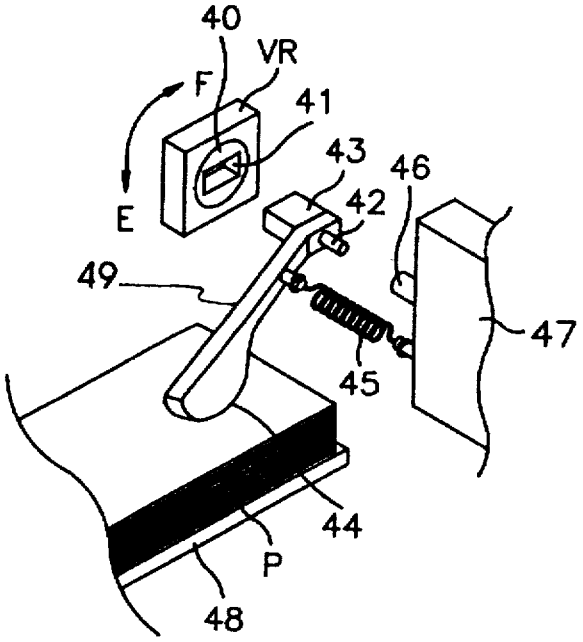
FIG. 4 is a view illustrating the mechanical structure of a sensor of FIG. 3.

Referring to FIG. 4, the mechanical connections of the remaining amount of paper sensing unit 6 will be further detailed. The variable resistor VR is has a rotatable wiper 40, and a inserting hole 41 provided in rotatable wiper 40. The sensor comprises an actuator arm 49 has a paper contacting end 44, which rests on the upper side of the top most sheet of paper in the stack P; and an opposite end having a projecting unit 43 extending from one side thereof, which is inserted into the inserting hole 41, and another projection 42 extending in a direction directly opposite projecting unit 43. A spring 45, of an elastic material, has one end thereof connected to a protrusion provided between contacting end 44 and the opposite end of the actuator arm 49 and the other end of the spring 45 is connected to a frame 47 of the image forming apparatus or the paper cassette. Spring 45 supplies an elastic force to the actuator arm 49 so that the paper contacting end 44 of the actuator arm 49 remains in contact with the top of the paper stack when during there is paper remaining in the stack.

A downward force is always supplied to the actuator arm 49 by the elastic force of the spring 45. Accordingly, when there are paper sheets remaining in the paper cassette, the paper contacting end 44 is in contact with the paper sheets, but when there is no paper remaining, the paper contacting end 44 contacts the fixed bottom 48 of the paper cassette. Therefore, as the paper sheets are consumed, the paper contacting unit 44 is lowered and the rotating unit 40 of the variable resistor VR rotates in the direction labelled E, thereby sensing that the amount of paper sheets is reduced in the manner described in an explanation of FIG. 3.

The projecting unit 43 of the actuator arm 49 inserted into inserting hole 41 of the variable resistor VR during the operation has to be stably assembled, because the variable resistor VR is not designed to accept a large mechanical force applied thereto. As a result, a projecting unit 46 extends from frame 47 to accept the projection 42 of actuator arm 49 in order to keep the sensor stable and to allow the variable resistor VR to remain in a stable state as assembled to the frame so that no undo force is applied thereto when actuator arm 49 is operated. Also, frame 47 can be modified to accept projection 42 by boring a hole in frame 47, and as such projecting unit 46 would not be necessary. Further, it is clear that variable resistor VR is stably mounted to frame 47. As noted previously, frame 47 is a part of either the image forming apparatus or the paper cassette.

Figure 5:
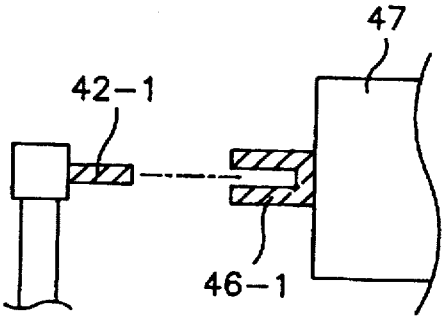
FIG.5 is a sectional view illustrating another each structure of an actuator and a frame of FIG. 4

In order to improve the stability of the operation, projection 42 is formed as a cylindrical projecting unit 42-1 and is rotatably inserted into the projecting unit 46-1 of frame 47 as shown in FIG. 5.

The present invention, as described above, has an advantage in that information regarding the remaining amount of stored paper in a paper cassette is readily displayable to the user thereby reducing user's anxiety regarding whether or not the stored amount of paper sheets is enough to complete a printing or copying operation. Moreover, when the printing or copying operation is capable of being started only when the state that the remaining amount of paper sheets is sufficient to complete the printing or copying operation, there is an advantage in that the down time due to a shortage of paper sheets during the printing or copying operation or the loss of time due to the repetition of the same operation such as resupplying paper sheets and then restarting the printing or copying operation can be reduced.

While the present invention has been described with reference to a few specific embodiments, the description is illustrative of the invention and is not to be constructed as limiting the invention. Various modifications may occur to those skilled in the art without departing from the true spirit and scope of the invention as defined by the appended claims.

What is claimed is:

1. An apparatus for sensing a stored amount of paper sheets in a paper storing means and for displaying the sensed amount of paper sheets on a display means, said apparatus comprising:

paper sensing means comprising:

a variable resistor having a first resistance value when said paper storing means is full of paper and a second resistance value when said paper storing means is empty of paper sheets, said variable resistor being connected to a reference potential;

actuator means connected to said variable resistor, said actuator means being in contact with a top most paper sheet of a stack of paper in said paper storing means, said actuator means incrementally changing the resistance value of said variable resistor between said first resistance value and said second resistance value as the amount of paper sheets in said stack of paper decreases;

another resistor connected to a voltage source and connected at a node to said variable resistor; and analog-to-digital converting means connected to said node for converting an analog voltage signal sensed at said node to a digital signal; and means connected to said paper sensing means for generating a stored paper amount sensing signal by determining the amount of paper sheets stored in said paper storing means in response to said digital signal.

2. The apparatus as set forth in claim 1, said actuator means comprising:

an actuator arm having a first end for contacting said top most paper sheet and a second end having a first projection connected to said variable resistor and a second projection for enabling said actuator arm to be rotatably mounted to a frame of said paper storing means; and biasing means connected between a third projection of said actuator arm and said frame for biasing said actuator arm in a downward direction to maintain contact with said top most paper sheet.

3. An apparatus for sensing a stored amount of paper sheets in a paper storing means and for displaying the sensed amount of paper sheets on a display means, said apparatus comprising:

paper sensing means comprising:

a variable resistor having a first resistance value when said paper storing means is full of paper and a second resistance value when said paper storing means is empty of paper sheets; and actuator means connected to said variable resistor, said actuator means being in contact with a top most paper sheet of a stack of paper in said paper storing means, said actuator means incrementally changing the resistance value of said variable resistor between said first resistance value and said second resistance value as the amount of paper sheets in said stack of paper decreases;

means connected to said paper sensing means for generating a stored paper amount sensing signal by determining the amount of paper sheets stored in said paper storing means in response to the incremental changes of the resistance value of said variable resistor;

means for inputting data indicative of a thickness of one sheet of paper to said means for determining the amount of paper sheets stored in said paper storing means; and said means for generating the stored paper amount sensing signal generating the stored paper amount sensing signal in response to said incremental changes of the resistance value of said variable resistor and said data indicative of the thickness of one sheet of paper.

4. The apparatus as set forth in claim 3, further comprising:

means for transmitting said stored paper amount sensing signal to said displaying means.

5. The apparatus as set forth in claim 3, wherein said paper sensing means further comprises:

another resistor connected to a voltage source and connected at a node to said variable resistor;

said variable resistor being connected to a reference potential; and analog-to-digital converting means connected to said node for converting an analog voltage signal sensed at said node to a digital signal.

6. The apparatus as set forth in claim 5, said actuator means comprising:

an actuator arm having a first end for contacting said top most paper sheet and a second end having a first projection connected to said variable resistor and a second projection for enabling said actuator arm to be rotatably mounted to a frame of said paper storing means; and biasing means connected between a third projection of said actuator arm and said frame for biasing said actuator arm in a downward direction to maintain contact with said top most paper sheet.

7. The apparatus as set forth in claim 5, said actuator means comprising:

an actuator arm having a first end for contacting said top most paper sheet and a second end having a first projection connected to said variable resistor and a second projection for enabling said actuator arm to be rotatably mounted to a frame of said paper storing means; and biasing means connected between a third projection of said actuator arm and said frame for biasing said actuator arm in a downward direction to maintain contact with said top most paper sheet.

8. An apparatus for sensing a stored amount of a stack of paper sheets in a paper cassette of an image forming device and for displaying the sensed amount of paper sheets on a display means, said apparatus comprising:

a voltage source;

a first resistor connected between said voltage source and a node;

a second resistor connected between said node and a ground, said first and second resistor comprising a voltage divider, said second resistor being variable to change a voltage provided at said node;

sensor means disposed to be in contact with a top sheet of said stack of paper sheets for altering a resistance value of said second resistor as the amount of paper sheets in said stack of paper sheets changes; and means responsive said voltage at said node for generating a paper amount sensing signal for displaying the sensed amount of paper sheets on said display means.

9. The apparatus as set forth in claim 8, said sensor means comprising:

an actuator arm having a first end for contacting said top sheet and a second end having a first projection connected to said second resistor and a second projection for enabling said actuator arm to be rotatably mounted to a frame of one of said paper cassette and said image forming device; and biasing means connected between a third projection of said actuator arm and said frame for biasing said actuator arm in a downward direction to maintain contact with said top sheet.

10. The apparatus as set forth in claim 9, said means responsive said voltage at said node for generating a paper amount sensing signal comprising:

analog-to-digital converting means for converting the voltage at said node to digital data; and means responsive to said digital data for determining the sensed amount of paper sheets in said paper cassette.

11. The apparatus as set forth in claim 11 said means responsive said voltage at said node for generating a paper amount sensing signal comprising:

analog-to-digital converting means for converting the voltage at said node to digital data; and means for transmitting said digital data to means responsive to said digital data for determining the sensed amount of paper sheets in said paper cassette.

* * * * *